US005893221A

United States Patent [19]

Weissman et al.

[11] Patent Number: 5,893,221

[45] Date of Patent: Apr. 13, 1999

[54] FOOTWEAR HAVING A PROTUBERANCE

[75] Inventors: Wayne David Weissman; Eric Uhrmacher, both of Mercer Island, Wash.

[73] Assignee: Forest Footwear L.L.C., Mercer Island, Wash.

[21] Appl. No.: 08/951,823

[22] Filed: Oct. 16, 1997

[51] Int. Cl.[6] ..... A43B 7/22

[52] U.S. Cl. ..... 36/91; 36/25 R; 36/166; 36/169; 36/172

[58] Field of Search ..... 36/91, 103, 127, 36/136, 116, 25 R, 140, 166, 145, 169, 172, 143, 144, 111

[56] References Cited

U.S. PATENT DOCUMENTS

| | | | |
|---|---|---|---|
| 2,179,942 | 11/1939 | Lyne . | |
| 2,295,212 | 9/1942 | Hamel . | |
| 3,861,398 | 1/1975 | Leydecker | 128/615 |
| 4,112,600 | 9/1978 | Hayward | 36/91 |
| 4,259,792 | 4/1981 | Halberstadt . | |
| 4,316,334 | 2/1982 | Hunt | 36/91 |
| 4,419,836 | 12/1983 | Wong | 36/11.5 |
| 4,572,196 | 2/1986 | Prahl . | |
| 4,819,940 | 4/1989 | Davis . | |
| 4,827,631 | 5/1989 | Thornton . | |
| 5,507,106 | 4/1996 | Fox | 36/103 |

FOREIGN PATENT DOCUMENTS

| | | | |
|---|---|---|---|
| 0746990 | 11/1996 | European Pat. Off. | A43B 7/14 |
| 398788 | 6/1909 | France . | |
| 1176263 | 4/1959 | France . | |
| 2462117 | 8/1979 | France | A43B 7/22 |
| 2511850 | 8/1981 | France | A43B 13/14 |
| 2707463 | 1/1995 | France . | |
| 404073001 | 3/1992 | Japan . | |
| 55919 | 5/1911 | Switzerland . | |
| 218016 | 6/1924 | United Kingdom . | |
| 2111821 | 7/1983 | United Kingdom . | |
| 8505256 | 12/1985 | WIPO . | |
| WO 90/00358 | 1/1990 | WIPO | A43B 13/00 |
| WO 91/03180 | 3/1991 | WIPO | A43B 13/04 |
| WO 91/11124 | 8/1991 | WIPO | A43B 13/00 |
| 91016830 | 11/1991 | WIPO . | |
| WO 94/03080 | 2/1994 | WIPO | A43B 13/00 |
| WO 96/07536 | 3/1996 | WIPO | B29D 31/508 |
| WO 96/39060 | 12/1996 | WIPO | A43B 13/00 |
| WO 96/39884 | 12/1996 | WIPO | A43B 13/20 |
| WO 97/00029 | 1/1997 | WIPO | A43B 13/14 |
| WO 97/01295 | 1/1997 | WIPO | A43B 13/14 |
| WO 97/03582 | 2/1997 | WIPO | A43B 13/18 |

OTHER PUBLICATIONS

Photocopy of a photograph of "Pygmy Feet".

*Primary Examiner*—Ted Kavanaugh
*Attorney, Agent, or Firm*—Seed and Berry LLP

[57] ABSTRACT

Footwear having an upper and a bottom, the bottom having an inwardly curved mid region, a protuberance is formed at the mid region which extends medially from the mid region beyond an imaginary line drawn from the widest part of the toe section of the footwear to the widest section of the heel of the footwear. In its preferred embodiments, the protuberance is convex in top plan view and convex in transverse sections starting from the widest area at the bottom of the protuberance and narrowing towards the top and in top plan view starting from a narrow front end of the protuberance being widest at midlength and then narrowing again at the end of the protuberance. Preferably, the protuberance is a medial extension of the longitudinal medial arch support of the footwear and has its vertical center line slightly rearward of the vertical center line of the longitudinal medial arch support.

20 Claims, 3 Drawing Sheets

FOOTWEAR HAVING A PROTUBERANCE

TECHNICAL FIELD

The present invention relates generally to footwear and more particularly to achieving better support for the foot of the wearer of the footwear.

BACKGROUND OF THE INVENTION

Footwear in general has an upper and a bottom, the bottom herein will be referred to as the sole and may be a one piece unitary sole with a tread and a foot support region above the tread or may be made of multiple pieces such as an out sole, a midsole, and a sock liner. In general, these footwear all will have an inwardly curved mid region on the medial side of the footwear. The mid region generally runs from a toe box (which houses the toes and ball of the foot) rearwardly to the forward end of a heel cup. Also, the footwear generally will have a longitudinal medial arch support running between the heel cup and the toe box to support the longitudinal medial arch of the foot of the wearer. Various techniques have been employed to improve the support of the longitudinal medial arch support, the toe box and the heel cup to give the wearer of the footwear more stability and to reduce strain on the various joints and tissues of the foot.

SUMMARY OF THE INVENTION

Applicants have made observations of Pygmy feet and have observed that their medial arches were more prominent allowing for more stability and that the Pygmies' metatarsals (the long bones of the foot) were fanned out, allowing for more stability. With these observations the applicants then constructed a unique bottom for footwear that allowed for more splaying of the metatarsals and provided more support at the longitudinal medial arch by adding a protuberance that extended medially from the inwardly curved mid region of the bottom within the area of the longitudinal medial arch support of the footwear forming a medial (towards the opposite foot) extension of the longitudinal medial arch support to provide midfoot support by reducing excessive plantar and medial displacement of the talus (pronation) during midstance of gait and limiting sub-talar eversion and provides midtarsal joint stability during propulsion, and supporting the medial longitudinal arch reducing strain on the plantar fascia. While these advantages have been achieved, the footwear also simply provides more comfortable wear and improved support for the foot.

It is an object of this invention to provide footwear having a protuberance that provides better support for the foot of the wearer of the footwear.

It is another object of this invention to provide a footwear having a protuberance which provides midfoot support by preventing excessive plantar and medial displacement of the talus (pronation) during midstance of gait, limits sub-talar eversion and provides midtarsal joint stability during propulsion, and supports the medial longitudinal arch reducing strain on the plantar fascia. The present invention in one embodiment includes a footwear having a bottom and an upper, the bottom having an inwardly curved mid region on the medial side of the foot curved in from an imaginary line running from the widest transverse section of the toe box of the footwear to the widest transverse section of the heel of the footwear, and a unique protuberance extending out and medially from the curved mid region starting at the bottom of the sole at its widest transverse width and rising upwardly to its narrowest transverse width. In preferred forms, the protuberance is convex in top plan view and convex in transverse section through the footwear. Also in the preferred embodiment, the top of the protuberance terminates approximately at the top of the longitudinal medial arch support in the footwear. The protuberance extends in a medial direction (toward the opposite foot) from the longitudinal medial arch support in the curved mid region beyond the imaginary line drawn from the widest section of the toe box of the footwear to the widest section of the heel of the footwear so that it extends out considerably from the inside edge of the curved mid region.

The shape of the protuberance in transverse section is preferably convex starting at its widest at the bottom of the outer surface of the sole and narrowing as it rises to its upper end. However, other shapes, such as an angle, providing similar function are also considered within the scope of the invention.

Similarly, the preferred shape of the protuberance in top plan view is convex starting from a narrow forward end with a widest section at its midlength and then narrowing again at its rearward end. However, again, other geometric shapes, such as an angle, that provide similar function are also considered within the scope of the invention. In the preferred embodiment the vertical center line along the midlength of the protuberance is slightly rearward of the center line of the longitudinal medial arch of the foot.

DETAILED DESCRIPTION OF THE INVENTION

The footwear is designed for any type of user from small child to adults and for leisure footwear, such as sandals, athletic footwear, hiking boots, to heavy work boots used by adults who carry heavy loads. In general, the advantages of the footwear are best achieved by locating the transverse center plane 37 of the protuberance slightly rearward of the center plane 36 of the longitudinal medial arch of the wearer's foot and having the protuberance begin forwardly at about midlength of the first metatarsal bone of the foot and terminating rearwardly at about the sub-talar joint of the foot. In this position the protuberance provides midfoot support by preventing excessive plantar and medial displacement of the talus (pronation) during midstance of gate. It limits sub-talar joint eversion and provides midtarsal joint stability during propulsion. The protuberance supports the medial longitudinal arch reducing strain on the plantar fascia and helping the risk of developing plantar fasciitis. The protuberance provides a bio-mechanically stable platform during gait. It provides a broad base of the midsole and out sole that is stabilizing the foot by providing a broader area of support with increased surface area on the bottom of the foot.

Figure 1:
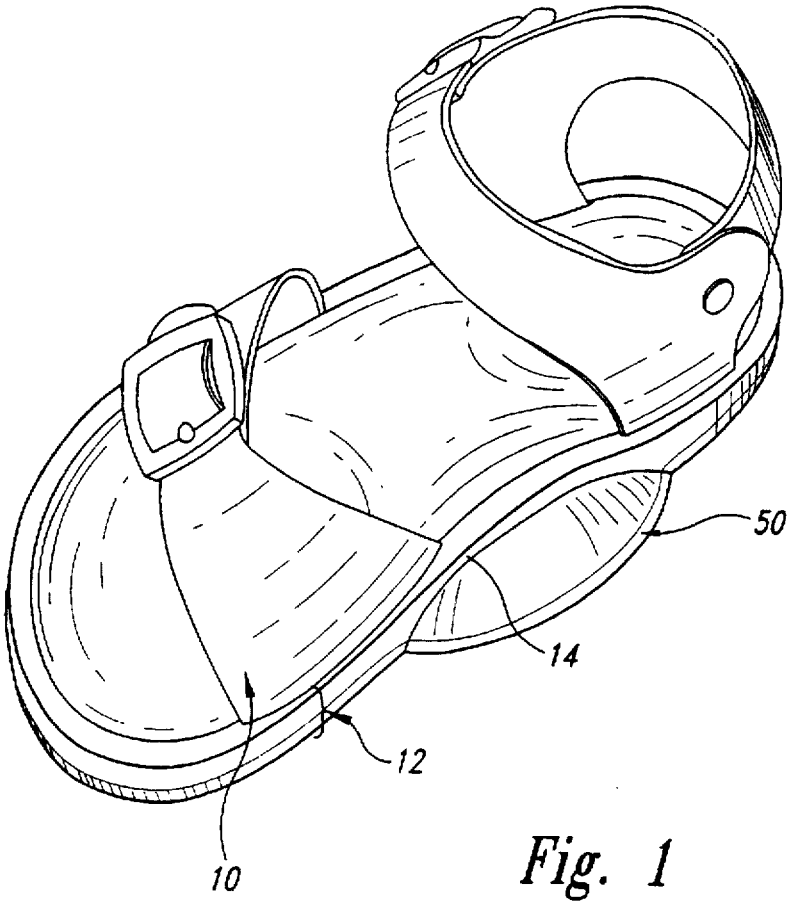
FIG. 1 is an isometric of the footwear employing the inventive features.
Figure 3:
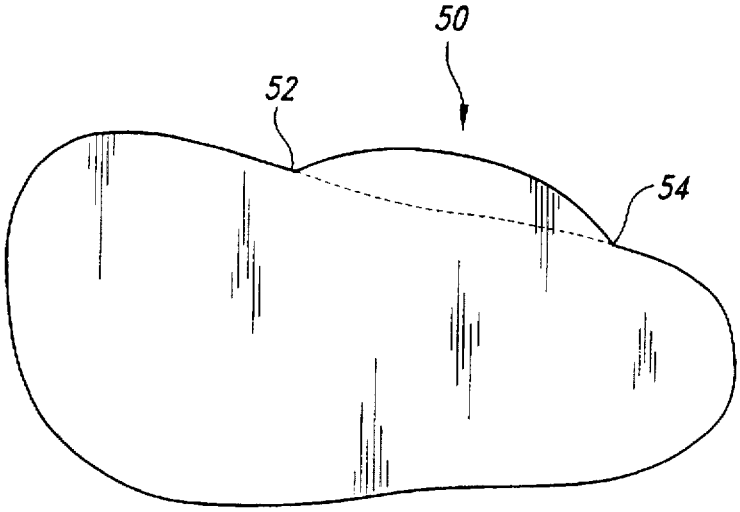
FIG. 3 is a bottom plan view of the footwear.
Figure 4:
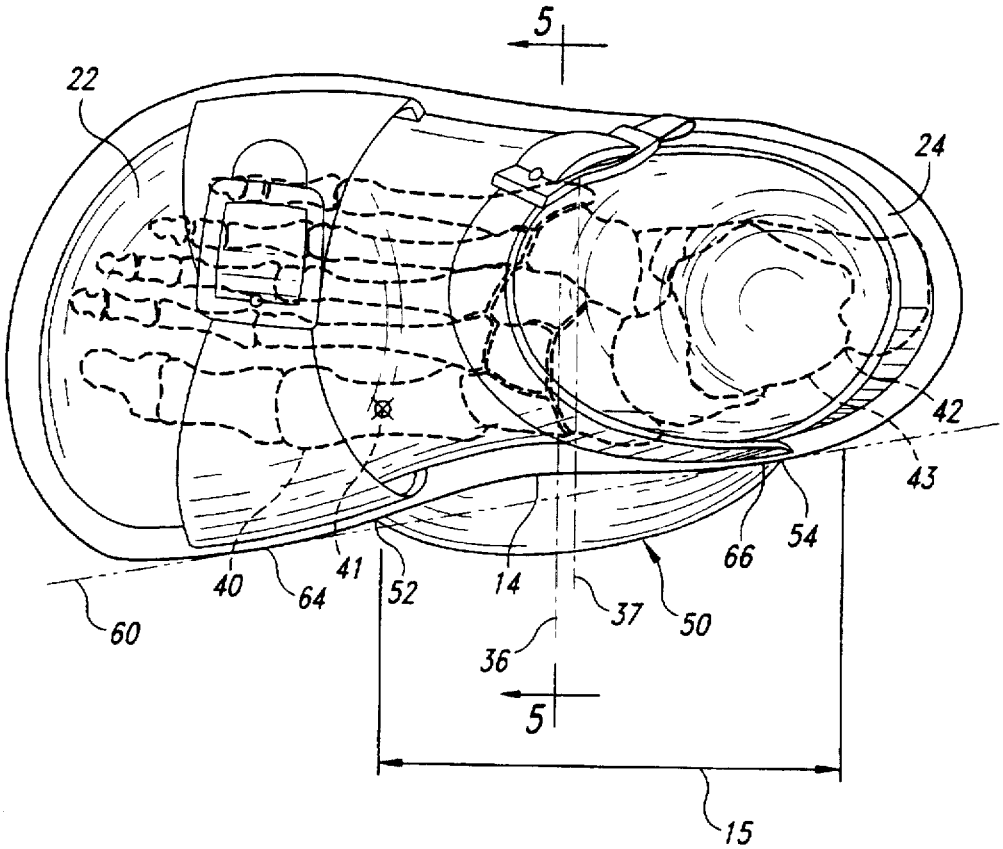
FIG. 4 is a top plan view.

As best shown in FIG. 1, the footwear includes an upper 10 a bottom 12 having an inwardly curved mid region 14 on the medial side of the footwear. The mid region extends lengthwise approximately the length of the dimension 15 as shown in FIG. 4. The upper can be a set of straps like as in a sandal of could be a fully closed upper as in a shoe or a boot. In the form of the invention illustrated in FIGS. 1, 5, and 6, the bottom 12 comprises an out sole, outer sole, or tread 16, a midsole 18 and a sock liner 20. The footwear also has a generally wide area in the front of the footwear called a toe box (FIG. 4) or toe end 22, which receives the toes and ball of the foot and a somewhat confined circular area at the rear of the footwear called a heel cup or heel end 24.

Figure 2:
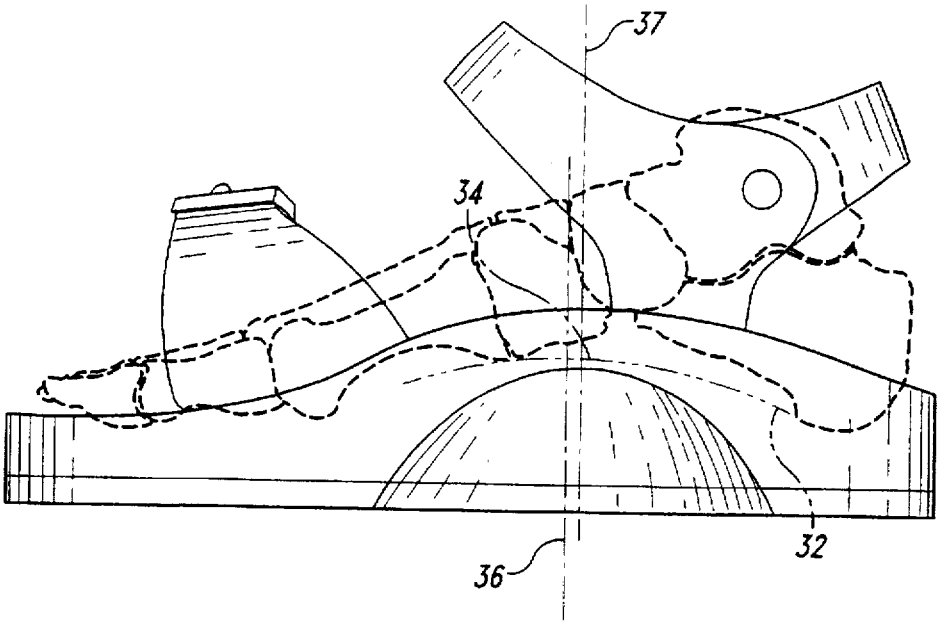
FIG. 2 is a side elevation looking in at the medial side of the footwear.

The out sole 16 is of a high density rubber or synthetic material commonly used for an out sole or tread. The midsole 18 is made from an EVA material (ethyl vinyl acetate) which is an ideal shock absorber and very durable. The sock liner consists of a self-molding material (closed cell, cross-linked, polyethylene) which conforms to the shape of the foot while walking and provides a customized foot bed for enhanced support and comfort. The toe box 22 is wider than normal to allow for natural metatarsal splaying spreading and thus reduces irritation around the medial and lateral bony prominences of the foot. The heel cup 24 is deeply recessed to control motion in the rear foot joints (sub-talar and midtarsal joints) and stabilizes the ankle by reducing inversion and eversion of the heel. Generally a shank 30 is between the out sole and the midsole along the center line of the footwear to provide more stiffness against longitudinal flexing. The midsole also has a longitudinal medial arch support 32 having an upper end 34 on the medial side of the foot and a vertical center line 36 as shown in FIGS. 2 and 4.

As can be seen in FIG. 4 the foot bones are shown in dot dashed lines and include a first metatarsal 40 having a midlength 41 and a sub-talar joint 42 at the rear of the talus 43.

Figure 5:
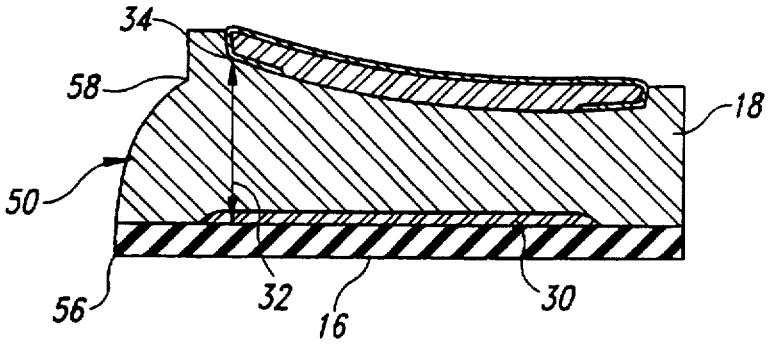
FIG. 5 is a section taken along the section line 5—5 of FIG. 4.
Figure 6:
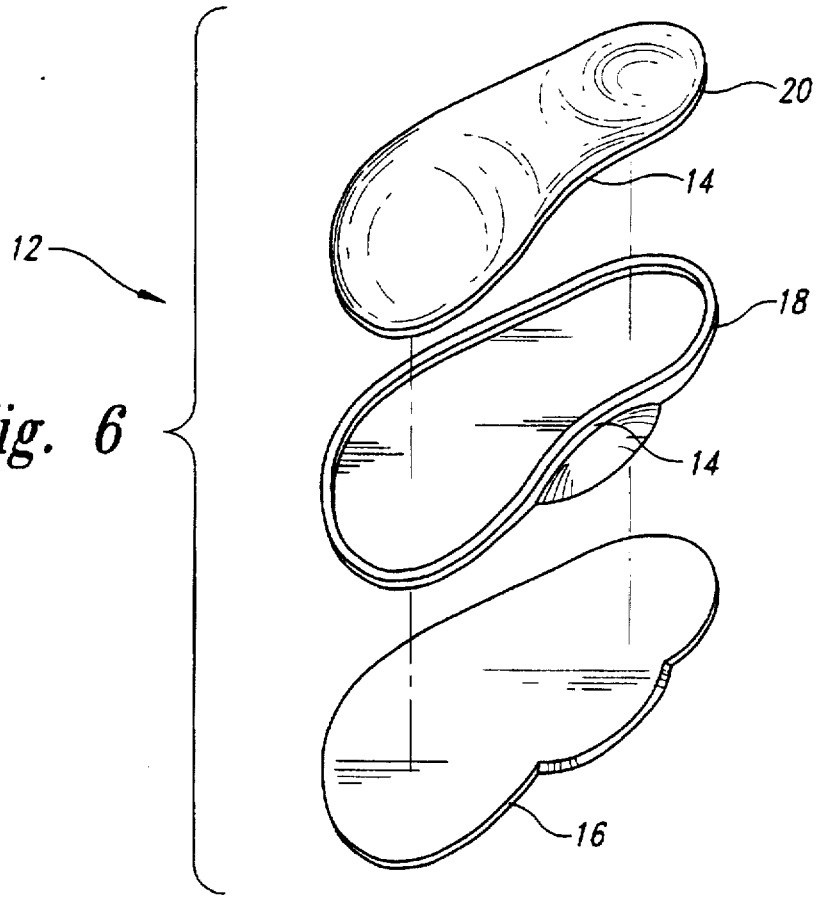
FIG. 6 is an exploded view of the sole portion of the footwear.

The unique protuberance of this invention is shown by reference numeral 50. As best shown in FIG. 4, the protuberance is outwardly convex in plan view and has a forward end 52 and a rearward end 54. The ends of the protuberance lay within the curve of the inwardly curved mid region 14 and preferably within the curve of the longitudinal medial arch support 32. The protuberance in transverse section is best shown in FIG. 5 and is upwardly convex starting from its widest lower end 56 and its narrowest upper end 58. The upper end 58 terminates approximately in line with the upper end 34 of the medial side of the longitudinal medial arch support 32. The bottom end of the protuberance extends all the way down to the outside surface of the out sole and is a part of the out sole. The protuberance is, in general, an exaggerated medial extension of the longitudinal medial arch support and extends considerably outwardly beyond an imaginary line 60 drawn between the widest part 64 of the toe box 22 and the widest part 66 of the heel cup 24. Thus, the protuberance is unusual in that it extends outwardly in a medial direction such a considerable distance whereas in a normal footwear the medial edge of the curved mid region of the bottom is well inside of the imaginary line between the widest section of the toe box and the widest section of the heel cup.

This location of the protuberance, and its width and length provide for the unique support of the foot of the wearer.

While the preferred embodiments of the invention have been illustrated and described, it should be understood that variations in the shape of the protuberance and in the composition of the materials of the footwear will be apparent to those skilled in the art.

Accordingly, the invention is not to be limited to the specific form of the invention illustrated in the drawings.

We claim:

1. Footwear having a bottom and an upper, comprising, a sole having a central heel cup for receiving the heel of the wearer and a central toe box receiving the toes and ball of the wearer, and having a medial edge, the medial edge of the sole being defined by an inwardly curved mid region having a length starting at about the toe box and ending at about a forward end of the heel cup, the sole having a bottom, the toe box and heel cup each having a respective widest transverse section, a protuberance extending medially from the mid region, the protuberance having front and rear ends and a length lying within the length of the mid region, the protuberance being widest at about its mid length and narrowest at its front and rear ends, the protuberance having a top, the protuberance extending medially beyond an imaginary straight line drawn from the widest transverse section of the toe box to the widest transverse section of the heel cup, the protuberance extending upwardly from the bottom of the sole, and being the transversely widest and extending furthest beyond said imaginary straight line at the bottom of the sole and transversely the narrowest at the top of the protuberance.

2. The footwear of claim 1, wherein the sole has a longitudinal medial inner arch support having a medial edge, the upper end of the protuberance terminating at said inside edge of the longitudinal medial arch support.

3. The footwear of claim 1, wherein the shape of the protuberance in a transverse plane through the sole is convex.

4. The footwear of claim 1, wherein the top plan view shape of the protuberance is convex.

5. The footwear of claim 4, wherein the shape of the protuberance in a transverse plane through the sole is convex and wherein the sole has a longitudinal medial arch support having a medial edge, the upper end of the protuberance terminating at said medial edge of the longitudinal medial arch support.

6. The footwear of claim 5, the footwear adapted to carry the foot of a wearer, the foot having a first metatarsal having a length with a midlength along its length, the foot having a longitudinal medial arch, and a talus with a sub-talar joint, the protuberance beginning forwardly from about the midlength of the first metatarsal, becoming wider rearwardly, then narrowing and ending at the sub-talar joint, wherein the protuberance is positioned to provide midfoot support by preventing excessive plantar and medial displacement of the talus (pronation) during midstance of gait, limits sub-talar eversion and provides midtarsal joint stability during propulsion, and supports the medial longitudinal arch reducing strain on the plantar fascia.

7. Footwear having a bottom and an upper, the bottom including a midsole and an outer sole each with medial side surface and having a toe end, a heel end, and a longitudinal medial arch support, the toe end includes the toes and ball of the foot of the wearer, the heel end includes substantially the heel of the wearer the outer sole having a bottom, the arch support being between the toe end and the heel end and having a forward end and a rearward end, the toe end and the heel end having respective widest parts, as viewed from above, and each widest part having an inside edge, the footwear having an inwardly curved mid region between the toe end of the footwear and the heel end of the footwear on the medial side of the footwear, the improvement comprising;

a protuberance having a top and a bottom, the protuberance extending in a medial direction from the inwardly curved mid region of the outer sole and mid sole, the protuberance bottom beginning at the bottom of the outer sole and extending medially and beyond an imaginary line drawn on the medial side of the footwear between the inside edge of the widest part of the toe end of the footwear and the inside edge of the widest part of the heel end of the footwear, the protuberance increasing continuously in transverse width with respect to said medial side surfaces of the outer sole and mid sole from top to bottom with the bottom of the protuberance at the outer sole extending transversely outward further than the ton of the protuberance, the protuberance having a forward end and a rearward end, the ends of the protuberance being wholly within a length of the longitudinal medial arch support of the footwear.

8. The footwear of claim 7, wherein the protuberance in top view increases in transverse width from the forward end of the protuberance to an approximate midpoint along the length of the protuberance and then decreases in transverse width to the rear end of the protuberance.

9. The footwear of claim 8, wherein the protuberance in top view is outwardly convex.

10. The footwear of claim 9, wherein the protuberance is outwardly convex from top to bottom.

11. The footwear of claim 9, wherein, the protuberance has a vertical center plane transverse to the protuberance, the longitudinal medial arch having a vertical center plane transverse to the longitudinal medial arch, the shape of the protuberance in a transverse plane through the midsole and outer sole is convex, and the vertical center plane of the protuberance is slightly rearward of the center plane of the longitudinal medial arch support.

12. The footwear of claim 7, wherein the protuberance is outwardly convex from top to bottom.

13. The footwear of claim 7, wherein the shape of the protuberance in a transverse plane through the midsole and outer sole is upwardly convex.

14. The footwear of claim 7, wherein the top view shape of the protuberance is convex.

15. Footwear having an outer sole having a bottom lying generally in a singular plane, a midsole with an inner longitudinal medial arch support having a medial edge, and a sock liner positioned in the midsole, comprising, the midsole having a central heel cup for receiving the heel of the wearer and a central toe box at the front of the midsole receiving the toes and ball of the wearer, the midsole and outer sole each having a medial edge, the heel cup and the toe box each having a respective widest transverse section, wider than any other Dart of the heel cup and toe box, the medial edges of the midsole and outer sole being defined by an inwardly curved mid region starting at about a rear of the toe box and ending at about a front of the heel cup, a protuberance extending medially from the medial edge of the inwardly curved mid region of the midsole and outer sole, the protuberance having a rear end and a front end both terminating within the length of the mid region, the protuberance being widest at about its mid length and narrowest at its front and rear ends, the protuberance extending medially beyond an imaginary straight line drawn from the widest transverse section of the toe box to the widest transverse section of the heel cup, the protuberance extending upwardly and outwardly from the bottom of the medial edge of the outer sole to the height of the medial edge of the longitudinal medial arch support of the midsole, and being the widest at the bottom of the outer sole and the narrowest at the top of the protuberance, wherein the protuberance is positioned to provide midfoot support by preventing excessive plantar and medial displacement of the talus (pronation) during midstance of gait, limits sub-talar eversion and provides midtarsal joint stability during propulsion, and supports the medial longitudinal arch reducing strain on the plantar fascia.

16. Footwear having a bottom and an upper, the bottom having an outer sole and mid sole with a longitudinal medial arch support having a medial edge terminating at an upper height, the bottom having an inwardly curved mid region adjacent to the longitudinal medial arch support extending from a toe box receiving the toe and ball of the footwear to a heel cup receiving the heel of the footwear, the footwear adapted to carry the foot of a wearer, the foot of the wearer having a first metatarsal having a length with a midlength along its length, the foot having a longitudinal medial arch, and a talus with a sub-talar joint, a protuberance formed on the mid and outer soles and having a top and a bottom, the protuberance getting larger from the protuberance top to bottom and beginning forwardly from about the midlength of the first metatarsal, becoming wider rearwardly, then narrowing and ending at about the sub-talar joint, the protuberance extending in a medial direction beyond an imaginary straight line extending from on inner edge of a widest part of the medial side of the toe box to, an inner edge of a widest part the medial side of the heel cup of the sole, the protuberance lying within the length of the longitudinal medial arch support, wherein the protuberance is positioned to provide midfoot support by preventing excessive plantar and medial displacement of the talus (pronation) during midstance of gait, limits sub-talar eversion and provides midtarsal joint stability during propulsion, and supports the medial longitudinal arch reducing strain on the plantar fascia.

17. The footwear of claim 16, wherein the top of the protuberance terminates at the height of the medial edge of the longitudinal medial arch support.

18. The footwear of claim 16, wherein the shape of the protuberance in a transverse plane through the sole is convex.

19. The footwear of claim 16, wherein the top plan view shape of the protuberance is convex.

20. The footwear of claim 19, wherein the shape of the protuberance in a transverse plane through the midsole and outer sole is convex and a vertical center plane of the protuberance is slightly rearward of a vertical center plane through the longitudinal medial arch support.

* * * * *